US006311664B1

(12) United States Patent
Jacobs et al.

(10) Patent No.: US 6,311,664 B1
(45) Date of Patent: Nov. 6, 2001

(54) IGNITION COIL OUTPUT PULSE CONTROLLED POWER SWITCH FOR INTERNAL COMBUSTION ENGINE

(76) Inventors: Christopher A. Jacobs, 1800 N. Midland Dr., #208; Gregory V. Puscas, 4001 Crestwood, both of Midland, TX (US) 79707

( * ) Notice: Subject to any disclaimer, the term of this patent is extended or adjusted under 35 U.S.C. 154(b) by 0 days.

(21) Appl. No.: 09/711,115

(22) Filed: Nov. 9, 2000

Related U.S. Application Data

(63) Continuation of application No. 09/541,415, filed on Apr. 3, 2000, now abandoned, which is a continuation of application No. 09/131,815, filed on Aug. 10, 1998, now Pat. No. 6,058,902.

(51) Int. Cl.[7] ..... F02B 77/00
(52) U.S. Cl. ..... 123/198 DC; 123/630
(58) Field of Search ..... 123/198 DC, 647, 123/644, 630; 361/154

(56) References Cited

U.S. PATENT DOCUMENTS

| | | |
|---|---|---|
| 4,058,103 | 11/1977 | Brocker . |
| 4,269,160 | 5/1981 | Irin, Jr. . |
| 4,300,495 | 11/1981 | Trevino et al. . |
| 4,641,627 | 2/1987 | Nash . |
| 5,101,802 | 4/1992 | Reinhard . |
| 5,423,305 | 6/1995 | Shih . |
| 5,554,891 | 9/1996 | Shimizu et al. . |
| 5,646,461 | 7/1997 | Kutoba . |
| 5,730,098 | 3/1998 | Sasaki et al. . |
| 5,775,310 | 7/1998 | Ito et al. . |
| 5,803,059 | 9/1998 | Jacobs et al. . |

*Primary Examiner*—Erick Solis
(74) *Attorney, Agent, or Firm*—Akin, Gump, Strauss, Hauer & Feld, LLP

(57) ABSTRACT

A power switch operable to change between a conductive and non-conductive state for use with an ignition circuit of an internal combustion spark-ignited engine and adapted to be disposed between the output conductor of a high voltage generator or ignition coil and an ancillary system, such as an aftermarket ignition system, anti-theft system or speed control governor circuit. The power switch receives a high voltage pulse-type signal from the engine's original equipment high voltage generator or "coil" and connects the primary power source, such as a battery, to the auxiliary system. Power is supplied to the ancillary system in synchronization with the output signal from the high voltage coil. The power switch is particularly adapted to permit use of aftermarket ignition systems and other auxiliary circuits with original equipment ignition systems without interrupting the electrical connections or systems that rely on signals from the high voltage generator or coil of the original engine ignition system.

13 Claims, 5 Drawing Sheets

IGNITION COIL OUTPUT PULSE CONTROLLED POWER SWITCH FOR INTERNAL COMBUSTION ENGINE

This application is a continuation of application Ser. No. 09/541,415, filed Apr. 3, 2000 now abandoned which is a continuation of application Ser. No. 09/131,815, filed Aug. 10, 1998, U.S. Pat. No. 6,058,902.

FIELD OF THE INVENTION

The present invention pertains to a system including a switch operable to provide for a steady state connection of an electrical power source to a power consuming system or device associated with a spark ignited internal combustion engine as a consequence of an input signal from a coil or similar high voltage generator of the engine ignition system.

BACKGROUND OF THE INVENTION

Spark ignited single and multi-cylinder internal combustion engines are ubiquitous. Until recent years, a large majority of automotive spark-ignited internal combustion engines, in particular, operated with ignition systems which provided timed distribution of high energy "sparks" to the sparkplugs of the respective engine cylinders utilizing a circuit wherein a mechanical switching device known as a distributor conveys electrical current to the respective sparkplugs of the engine according to the cylinder firing order. The distributor receives a high voltage source of energy from a high voltage generator device or so-called "coil" having primary and secondary windings. The primary winding is connected to a contact breaker switch which opens and closes in timed relationship to the engine cylinder firing order so as to induce the high voltage signal in the coil secondary winding which is distributed by way of the distributor to the respective cylinders at the appropriate times for ignition of the fuel-air charge in the cylinders. Such ignition systems are essentially uncomplicated and can easily be replaced by superior performing aftermarket ignition systems or can provide for adaptation of certain devices such as vehicle anti-theft or security systems, tachometers, speed limiting governors and other devices adapted to operate off of the ignition system.

More recently, ignition systems have been developed which, in some cases, replace the mechanical contact breaker type spark distributor with transistor or so-called reluctor-type devices to effect operation of the high voltage spark generator or coil. For example, spark-ignited automotive internal combustion engines have been developed wherein the ignition "coil", or high voltage generator device or devices comprising part of the ignition system, not only generates energy for fuel-igniting sparkplugs, but energy reflected back from the coil primary winding output signal is used to control fuel injection systems, exhaust emission devices and certain other engine and/or vehicle functions. This has increased the difficulty of connecting aftermarket devices that are designed to receive power from the vehicle electrical system, including the battery, only while the engine is operating. Insuring that the proper connections are made for an ancillary system or an aftermarket product of the types mentioned above can be particularly difficult for persons not having access to the engine or vehicle electrical system schematic diagrams, or persons who may be generally unfamiliar with the details of engine electrical systems.

Still further, since many ancillary or aftermarket devices or systems must be generalized for use with a wide variety of engines and vehicles, the complexity and resulting confusion experienced in attaching such devices is aggravated. Of course, if a proper connection of the aftermarket system is not accomplished, engine failure may result or the aftermarket system, the engine or other systems comprising part of the engine electrical system, or associated vehicle electrical system, may be damaged. Accordingly, there has developed an acute need for a device which may be used to provide for connection of (1) an ancillary or aftermarket device, such as an ignition system, to the engine or (2) connection of other ancillary devices to the primary electrical power source (such as a twelve volt battery) only when the engine is starting or running while avoiding the problems of trying to locate the proper conductors of the electrical system. The present invention has been developed to overcome the above-mentioned problems and to provide other advantages and conveniences which will be recognized by those skilled in the art.

SUMMARY OF THE INVENTION

The present invention provides a switch which is operable to receive a high voltage, repetitive, pulse-type output signal from a high voltage generator or so-called "coil" comprising part of an ignition system of a spark-ignited internal combustion engine and which is operable to connect an ancillary device to or disconnect such device from a primary power source, such as the electrical system battery, continuously as long as the high voltage pulse-type signal is received from the "coil". The present invention also provides a synchronizing device that is controlled by an output signal from a spark-ignited engine ignition system which provides a power signal to or, alternatively, may disconnect a power signal from an aftermarket system or ancillary device when the engine ignition system is operating.

In accordance with an important aspect of the invention, a synchronizing or power switch is provided which can be connected to an existing engine ignition system without replacing any parts thereof. The switch of the present invention provides for ease of attachment or connection to an existing engine electrical system without interference in the operation of same. The invention permits use of virtually any ancillary or aftermarket electrically powered device with any vehicle electrical system without the need to provide any significant wiring or rewiring of the original existing system electrical connections. Moreover, the present invention may be used in connection with existing spark ignition systems for internal combustion engines, particularly for automotive applications, without modifying any of the electrical connections or subsystems that rely on signals from the original ignition system.

One preferred embodiment of the invention is operable to receive a negative polarity high voltage pulse-type signal from a high voltage generator or "coil" device and provide a continuous or steady state voltage of positive polarity from a primary electrical power source, such as the engine starting and running battery, to an ancillary power consuming device or system. One alternate embodiment of the invention is operable to receive an input signal comprising a high voltage, low current pulse signal of positive polarity from a high voltage generator or coil to provide a continuous low voltage output to a power consuming device or system from the engine primary power source.

The present invention still further provides switch embodiments wherein power to an ancillary or aftermarket device or system is interrupted when a pulse-type high voltage signal is received from a high voltage generator or coil of an ignition system. The last mentioned embodiments of the invention are provided wherein the power is interrupted when a substantially negative polarity signal is received or when a substantially positive polarity signal is received, respectively.

Those skilled in the art will further appreciate the advantages and features of the present invention together with other superior aspects thereof upon reading the detailed description which follows in conjunction with the drawing.

DETAILED DESCRIPTION OF PREFERRED EMBODIMENTS

Figure 1:
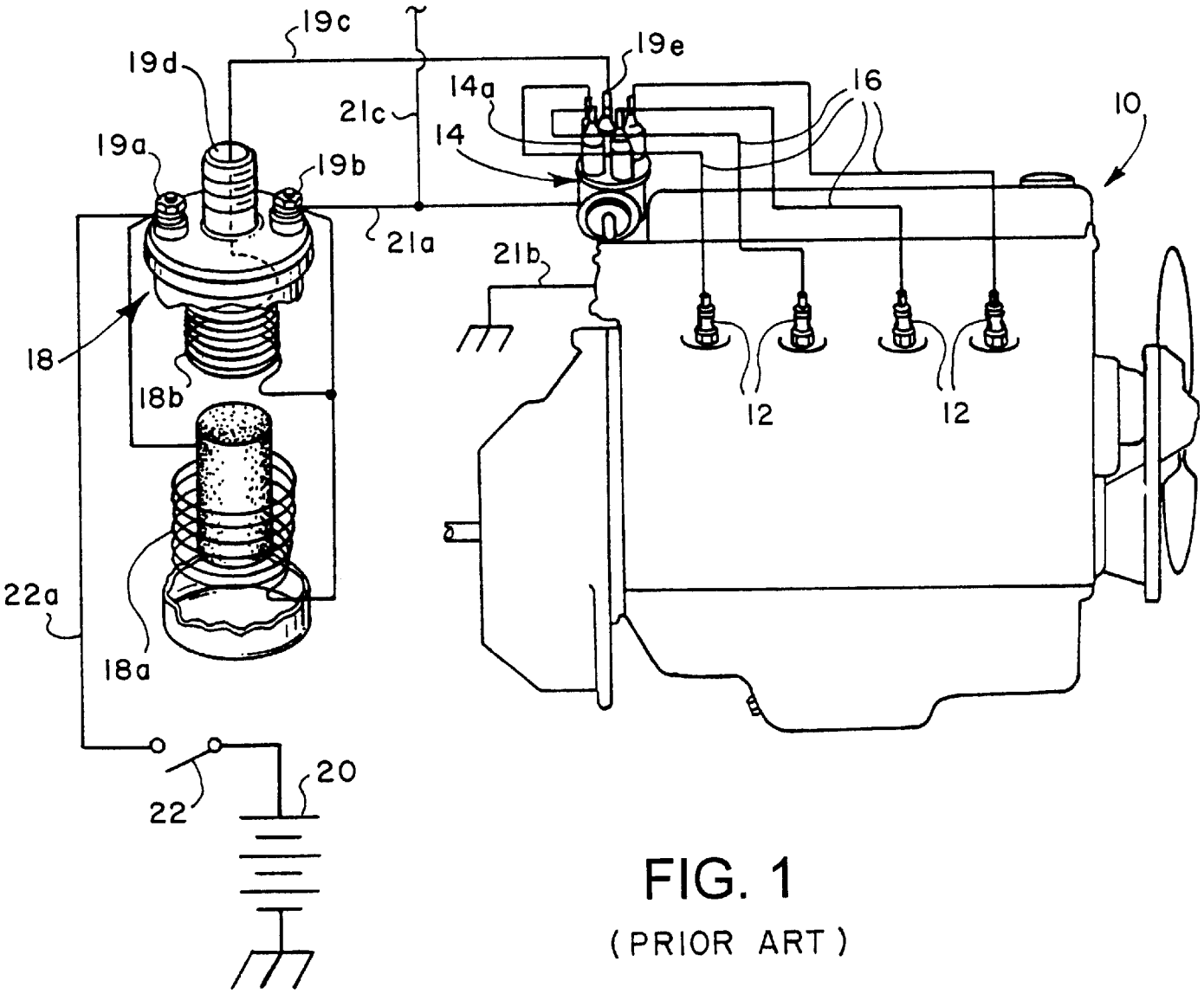
FIG. 1 (PRIOR ART)
FIG. 1 is a somewhat schematic diagram of a spark-ignited internal combustion engine including a prior art, conventional ignition system.

In the description which follows like elements are marked throughout the specification and drawing with the same reference numerals, respectively. The drawing figures are not to scale. Certain elements may be shown in generalized or schematic form in the interest of clarity and conciseness.

Referring to FIG. 1, there is illustrated a typical prior art ignition system for a spark-ignited multi-cylinder internal combustion engine, generally designated by 10. The engine 10 is a conventional, inline, multi-cylinder engine operating on either a two-stroke or four-stroke cycle in accordance with the basic Otto thermodynamic cycle. A further detailed description of the engine 10 is not believed to be necessary to practice the present invention.

As shown by way of example, the engine 10 includes a sparkplug 12 for each of four separate cylinders, not shown, for igniting a fuel-air charge drawn into such cylinders in a known way. The engine 10 is also provided with a mechanically driven conventional, contact breaker, ignition system distributor 14 of a well known type which is mechanically linked to the engine crankshaft, not shown, so as to drive a distributor cam and rotor, also not shown, in a timed manner in accordance with the rotation of the crankshaft. Suitable conductors 16 extend from the distributor cap 14*a* of the distributor 14 to the respective sparkplugs 12. The conventional prior art ignition system also includes a so-called "coil" 18 comprising a high voltage generator which is connected to a suitable primary source of direct current electric power, comprising a battery 20, by way of a conductor 22*a* connected to terminal 19*a*. The coil 18 is energized when an ignition switch 22 is moved to a closed position. A conventional engine electric starter circuit has been omitted from FIG. 1 in the interest of conciseness.

The coil 18 includes a primary winding 18*a* and a secondary winding 18*b* of conventional construction. Coil windings 18*a* and 18*b* are grounded through conductors 21*a* and 21*b* having a conventional contact breaker switch mechanism, not shown, interposed therein. An instrumentation conductor 21*c* is typically operably connected to the primary winding output conductor 21*a*, as shown. When the movable contact breaker switch or "points", not shown, of the distributor 14 interrupt the flow of current in the primary winding 18*a*, a high voltage potential, having a peak value in the range of 12,000 volts to 26,000 volts, is generated by secondary winding 18*b* which is conducted via conductor 19*c* to one of the conductors 16 whose distributor cap contact is in proximity to the aforementioned distributor rotor, again in a known manner. Additional description of a conventional contact breaker ignition system, as well as other types of automotive engine ignition systems, may be found in the publication entitled: "The Doctor's Step-by-Step Guide to Optimizing Your Ignition," Christopher A. Jacobs, Ph.D., *Jacobs Technical Publications*, Midland, Tex., 1996.

As further shown in FIG. 1, the coil terminals 19*a* and 19*b* may also be easily accessed to connect aftermarket devices to provide a suitable source of power thereto from the battery 20. Moreover, conductor 19*c*, commonly known as the coil wire, leading from the coil secondary winding 18*b* to the distributor 14, is also easily accessible in conventional prior art internal combustion engine ignition systems.

Various types of ignition systems have been developed in recent years wherein easy access to electrical power terminals, such as the terminals 19*a* and 19*b*, is no longer available for connection of certain aftermarket devices useful on internal combustion engines, particularly automotive internal combustion spark-ignited engines. For example, as mentioned above, ancillary systems or devices including aftermarket ignition systems, speed control governors and anti-theft devices which utilize a high voltage output signal to operate such systems cannot be easily connected to modern automotive electrical systems and, particularly, the circuitry of the ignition system. Typical modern automotive ignition systems, such as electronic ignition systems, which use a reluctor in place of the contact point ignition, or a computerized sparkplug processor, regulator and distributor are difficult for the average consumer and purchaser of ancillary or aftermarket equipment to easily connect to the engine ignition system.

However, virtually all spark-ignited internal combustion engines do utilize a high voltage generator or so-called "coil" to provide a high voltage, repeating, pulse-type signal which is conducted to each of the sparkplugs, such as the sparkplugs 12, in a pre-determined sequence and in timed relationship to the rotation of the engine crankshaft. For example, as shown in FIG. 1, a coil output conductor 19*c* is connected to distributor 14. Access to conventional ignition coil output conductors, such as conductor 19*c*, is substantially always available for connection to other conductors. In any case, even though the conventional contact point ignition distributor, such as the distributor 14, may not be a available for connecting an aftermarket ignition system, nor may a conventional coil, such as the coil 18, be available for connection of an aftermarket ignition system or other device to the engine ignition system, an equivalent device to the coil 18 is available in the ignition system and, in automotive engines, in particular, access to the electrical system power source or battery, such as the battery 20, is easily accessible for connection of an ancillary device.

Accordingly, ensuring that the conductors of an ancillary or aftermarket device, such as mentioned above, are properly connected to the engine electrical system can be most difficult for a person not having a complete circuit diagram available and not being familiar with a particular engine or vehicle. Alternatively, it may be required to effectively switch power off to an ancillary system or aftermarket product when there is an output signal from the ignition system high voltage generator or coil.

Figure 2:
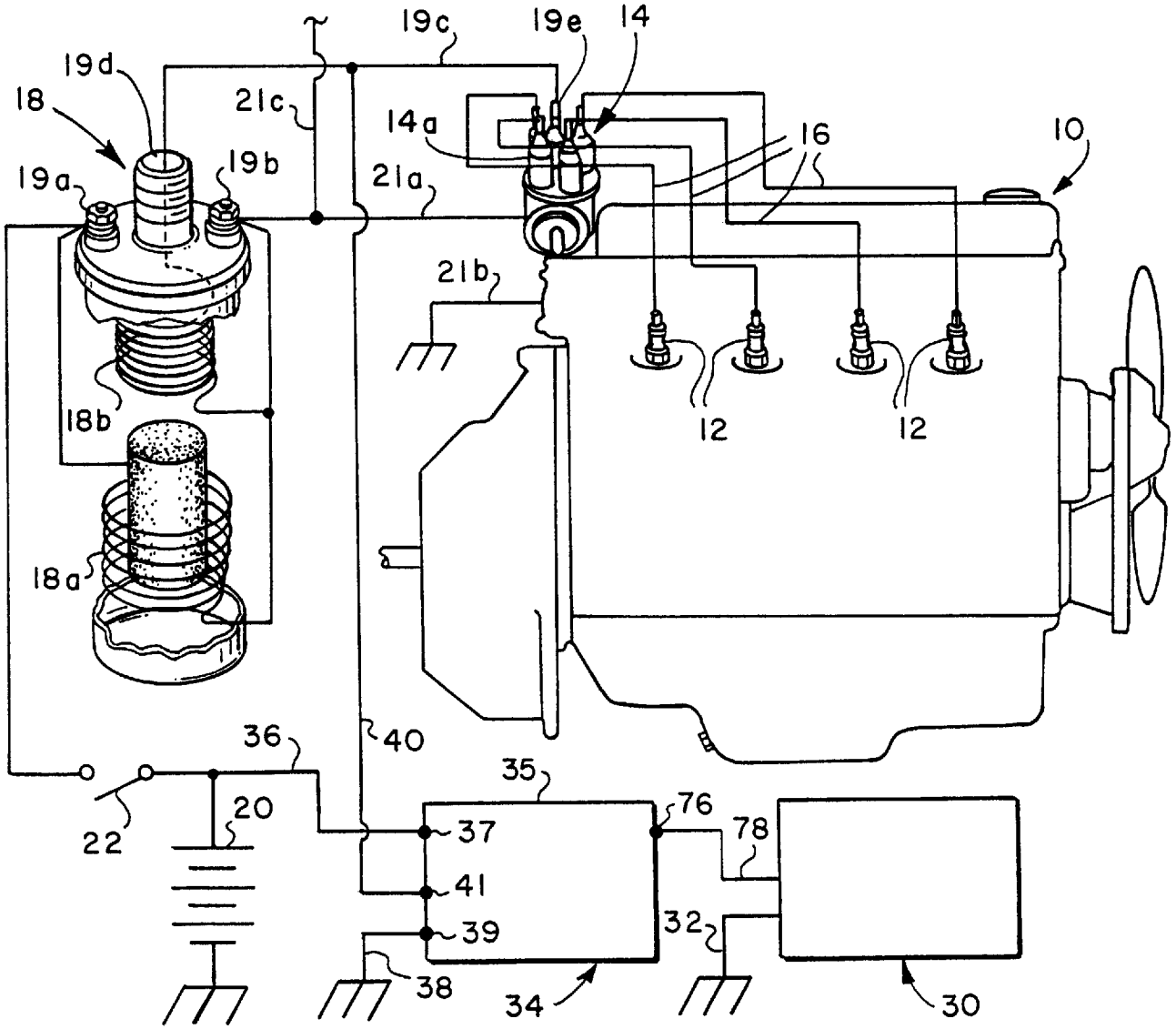
FIG. 2 is a schematic diagram showing the power switch of the invention connected to a prior art ignition system, such as the system illustrated in FIG. 1, and to an ancillary power consuming device.

Referring now to FIG. 2, there is illustrated an arrangement wherein an aftermarket electrical device or system 30 is connected to the electrical system for the engine 10. The device or system 30 may be an ignition system, an anti-theft or security system, or an engine power or speed-limiting governor, for example. In any event, the system 30 is adapted to be connected to the power source or battery 20 via a ground wire or conductor 32 and also via a switch in accordance with the present invention and generally designated by the numeral 34.

As shown in FIG. 2, the switch 34 is provided with power from the battery 20 by way of conductors 36 and 38, since the power source, such as the battery 20, is usually conveniently accessible in the engine compartment of a motor vehicle utilizing an engine 10, for example. The only other connection required for the switch 34 is to the conductor 19*c*, by way of a conductor 40. Conductor 40 may, of course, be connected to conductor 19*c* at terminals 19*d* or 19*e* of the coil 18 or distributor 14, respectively. The conductors 36, 38 and 40 are connected to suitable terminals 37, 39 and 41 respectively, comprising part of the switch 34. Accordingly, the switch 34 is operable to receive a high voltage pulse-type output signal from the high voltage generator or coil device 18 of the engine ignition system which, only by way of example shown in FIG. 2, is shown connected to the prior art contact point ignition system previously described in conjunction with FIG. 1.

For purposes of discussion herein, it will be assumed that the switch 34 may be connected to any electrical system of a spark ignition engine which has a high voltage generator for generating sufficient voltage for the engine ignitors or sparkplugs 12. Connecting the conductor 40 to the output terminal, directly or indirectly, of a high voltage generator such as the coil 18, does not affect operation of the coil nor the high voltage signal delivered directly or indirectly to the sparkplugs 12. In the example illustrated in FIG. 2, the aftermarket device 30 is not indicated to be a replacement ignition system. The ancillary or aftermarket device 30 may be one of several devices which are adapted to become operable or inoperable in response to an output signal from coil 18.

Figure 3:
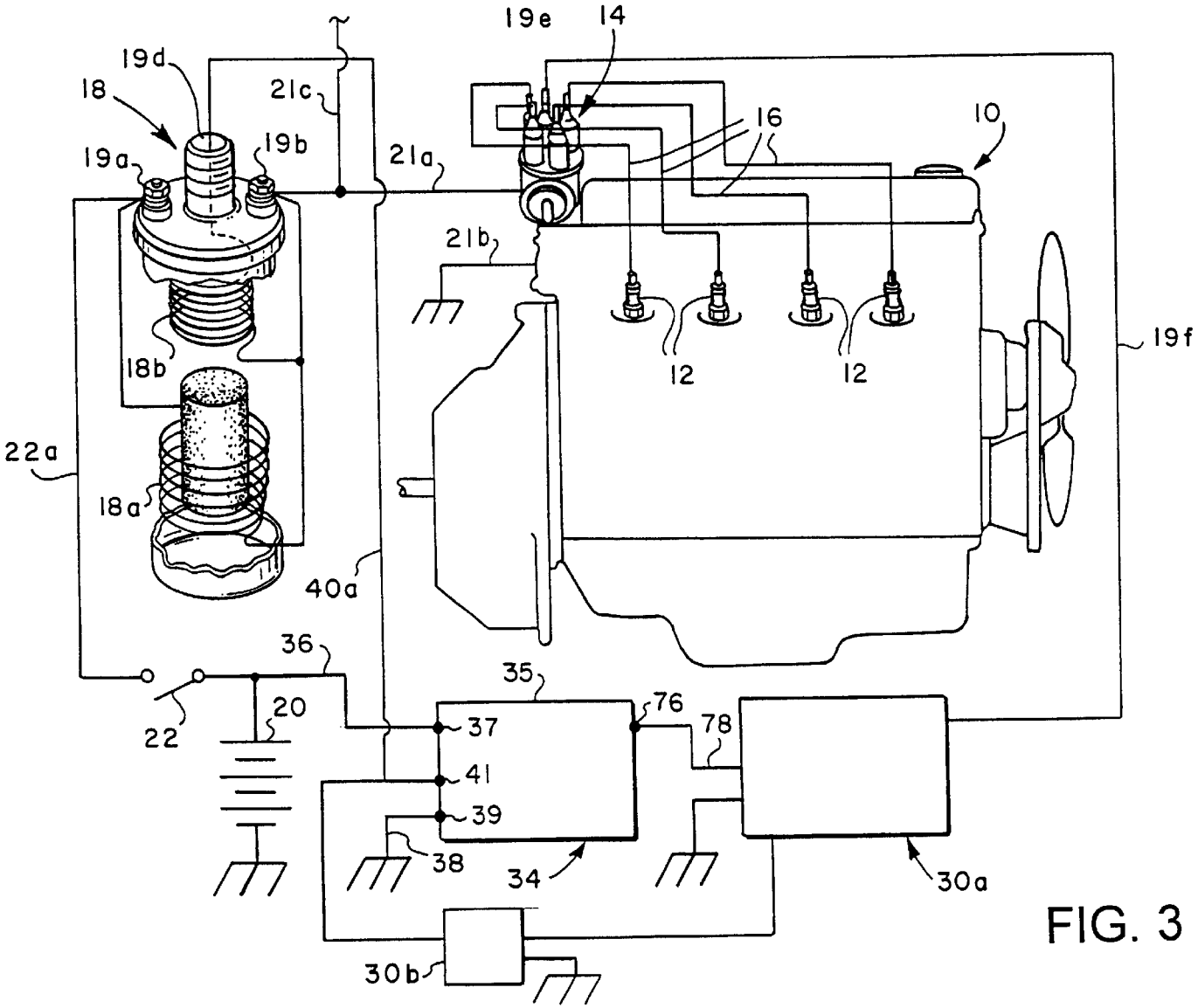
FIG. 3 is a diagram showing the power switch of the invention connected to an aftermarket ignition system to provide power to same from a primary electrical power source.

However, as shown in FIG. 3, the switch 34 may also be used to provide power to an ancillary or improved ignition system 30*a* which replaces the original ignition system in the sense that an output signal from coil 18 at terminal 19*d* is used to cause the switch 34 to supply power to the ignition system 30*a* which includes an output signal conductor 19*f* connected to the distributor 14 at terminal 19*e* in place of the coil output signal conductor 19*c*. Moreover, the ignition system 30*a* may utilize a coil output signal converter 30*b* in accordance with the invention disclosed and claimed in our co-pending U.S. patent application Ser. No. 08/880,894, filed: Jun. 23, 1997. Still further, with regard to the specific embodiment of FIG. 3, the original coil or high voltage generator 18 may also remain operable for carrying out certain other functions, if needed, by conducting signals via conductor 21*c*, for operating instrumentation, including an original equipment tachometer, fuel injection systems, emission control systems and other devices which may rely on a signal from the high voltage generator or "coil" to perform their functions, respectively. Moreover, since terminal 19*b* and conductors 21*a* and 21*c*, for example, may be inaccessible, switch 34 and converter 30*b* advantageously use the signal output at terminal 19*d* which is virtually always accessible.

In the diagram of FIG. 3, the aftermarket ignition system 30*a* is connected to the distributor 14 at terminal 19*e* or to an equivalent device by way of conductor 19*f*. In this arrangement, the sparkplug firing signals which originated from the engine's original ignition system are provided to the aftermarket ignition system 30*a* without requiring modification to the original system other than to replace the coil output conductor 19*c* with conductor 40*a* and conductor 19*f*, as indicated in FIG. 3. Connection of switch 34 to power source 20 is also easily done due to the accessibility of a power conductor 36 in virtually all situations.

In both of the applications of the power switch 34 illustrated in FIGS. 2 and 3, the power switch receives a limited amount of energy generated by the coil 18 and converts this energy into a signal which allows power from the primary power source or battery 20 to be switched to the system 30 or 30*a*. With regard to the arrangement of FIG. 2, the remaining amount of energy generated by the coil 18 is transmitted to the distributor 14. With regard to the arrangement of FIG. 3, the remaining amount of energy generated by the coil 18 is transmitted by way of conductor 40*a* to the signal converter 30*b* to provide a suitable synchronizing signal for the ignition system 30*a*.

Figure 4:
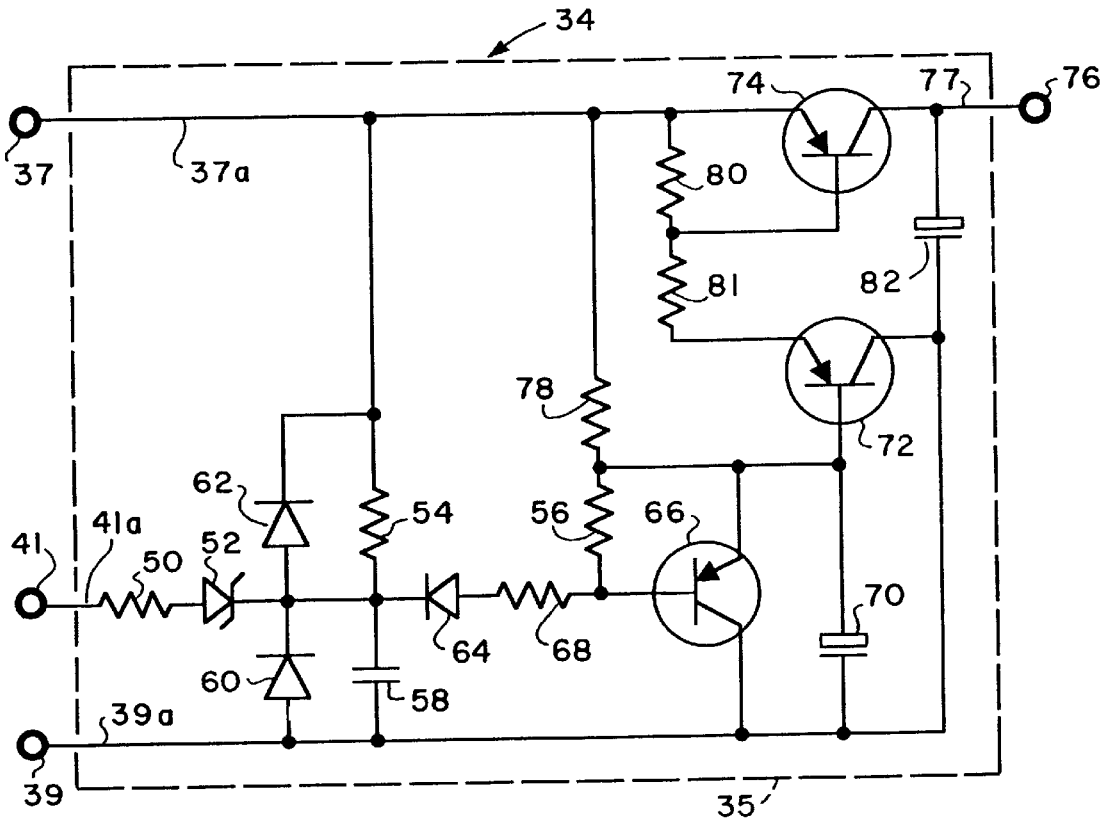
FIG. 4 is a schematic diagram of one embodiment of the power switch of the present invention.

Referring now to FIG. 4, one preferred embodiment of the present invention is illustrated comprising the power switch 34 wherein, for a negative ground electrical system, the positive terminal of the power source or battery 20 is connected, by way of the conductor 36, to terminal 37 and an internal switch conductor 37*a*. A terminal 39 is connected to an internal switch conductor 39*a* and to ground via conductor 38, as shown in FIG. 2, and the conductor 40 is connected to a terminal 41 and an internal conductor 41*a*. A high voltage repeating pulse signal of negative polarity, such as is output by a conventional automotive spark-ignited engine ignition system, is imposed on a resistor 50 which limits the amount of energy that is absorbed by the power switch 34. For example, for a 12-volt automotive engine ignition system, the resistor 50 is preferably rated at 2,200,000 ohms and 0.5 watts. Alternatively, the present invention could utilize a capacitor, an inductor, a transistor, a Zener diode, a silicon-controlled rectifier (SCR) or a controlled leakage diode in place of the resistor 50. A Zener diode 52, a resistor 54 and a resistor 56 act as a low voltage filter by cutting off low voltage signals below approximately twelve volts, for example. Moreover the Zener diode 52 allows for some hysteresis in the signal imposed on the terminal 41 which enhances the performance of the power switch 34. Resistor 50 and a capacitor 58, FIG. 4, also form a low pass filter that eliminates high frequency noise that can be captured from the conductors 19*c* and 40, for example. Resistor 54 is preferably rated at 4,700 ohms while resistor 56 is rated at 100,000 ohms and capacitor 58 is rated at 220 pF.

The power switch 34 illustrated in FIG. 4 further includes diodes 60 and 62 in circuit, as shown, which clamp the resultant negative voltage signal to less than 1 volt and the resultant positive voltage signal to less than minus 1 volt greater than the voltage from the power source or battery 20 via the terminal 37. The clamped negative voltage signal is then routed through a forward biased diode 64 to a common collector PNP non-inverting current amplifier, comprising transistor 66, through a resistor 68. Resistor 68, for the above-mentioned operating conditions and ratings of other components is preferably rated at 470 ohms to prevent excessive base current in the transistor 66. As indicated in FIG. 4, a capacitor 70 is in circuit with transistor 66. Capacitor 70 preferably has a capacitance of 10 uF and, as a consequence of the action of transistor 66 when receiving a pulse signal at terminal 41, rapidly discharges and also causes a base current through a, cascaded transistor 72 in circuit, as shown in FIG. 4, which results in a base current through a transistor 74 interposed in the circuit between conductors 37*a* and 77, also as shown in FIG. 4.

The base current through transistor 74 produces a resultant voltage at terminal 76 which is connected to a conductor 78, see FIGS. 2 and 3, for connecting the primary power source or battery 20 to the ancillary aftermarket device or system 30 or 30*a*. Resistors 78, 80 and 81 provide a stable off state for the power switch 34 when there is no output from the coil 18, for example, and therefore no signal is present at connection point 41. In a preferred embodiment of the power switch 34, having the other component parameters described hereinabove, the resistor 78 is rated at 68,000 ohms, resistor 80 is rated at 2,200 ohms and resistor 81 is rated at 1,500 ohms. A capacitor 82, in circuit as shown in FIG. 4, and having a capacitance of 220 uF also enhances the voltage stability between the terminal 76 and the ground terminal 39.

The power switch 34 receives as its input, a negative polarity high voltage signal from the coil 18 in a voltage range mentioned hereinabove and, upon receiving this signal, provides a steady state voltage of positive polarity from battery 20 for an ancillary device or a so-called aftermarket system 30 or 30*a*. Thanks to the arrangement of the circuit of the power switch 34, a steady state voltage potential from the battery 20 is provided to a device connected to the terminal 76 for essentially any operating condition of a multi-cylinder spark-ignited internal combustion engine since the frequency of the input signal to the circuit of switch 34 from the coil 18 is sufficiently great that the switch 34 is never effectively in an "off" position.

For example, substantially all spark-ignited multi-cylinder internal combustion engines used in automotive vehicles have at least an engine cranking speed and, of course, an idle speed great enough such that a high voltage generator, such as the coil 18, provides a plus-type signal to the switch 34 at a frequency sufficient to cause the switch 34 to provide power to a device such as the devices or systems 30 and 30*a*. The switch 34 is provided with a suitable enclosure 35 for the circuit described hereinbefore and the switch may be constructed using methods and materials known to those skilled in the art.

Those skilled in the art will also recognize that the switch 34 may be used on ignition systems using multiple coils, including systems that do not use a distributor and wherein there is one coil per cylinder or one coil per two cylinders, for example. Use of a spark inducing signal from any one of such multiple coils could be used to effect operation of the switch 34 and alternate embodiments thereof discussed hereinbelow.

Figure 5:
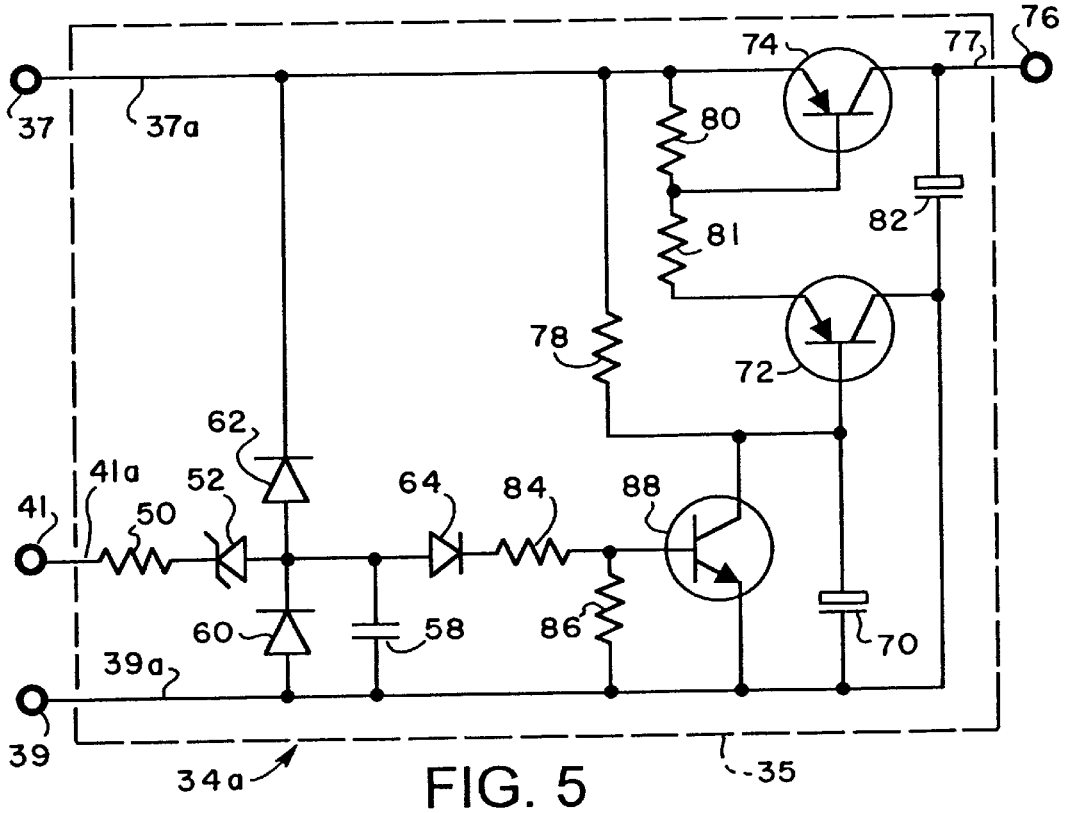
FIG. 5 is a schematic diagram of an alternate embodiment of a power switch in accordance with the present invention.

Many conventional (almost 99%) spark-ignited internal combustion engine systems utilize a coil output voltage of negative polarity. However, in certain instances a positive polarity high output voltage signal is issued from the spark-plug high voltage source or "coil". In the above-mentioned, somewhat rare instance, an embodiment of the invention illustrated in FIG. 5 is used in place of the embodiment illustrated in FIG. 4. Referring to FIG. 5, a power switch 34*a* is adapted to be interposed in circuit with the engine electrical system, such as shown in FIGS. 2 and 3, wherein a coil output voltage of positive polarity at terminal 41 is imposed on a resistor 50 which limits the amount of energy that is absorbed by the switch 34*a*. Moreover, as with the power switch 34, the switch 34*a* may utilize a capacitor, an inductor, a transistor, a Zener diode, a silicon-controlled rectifier (SCR) or a controlled leakage diode in place of the resistor 50. As a consequence of the reversed polarity of the pulse signal at terminal 41, Zener diode 52 and diode 64 are reversed in the circuit of the power switch 34*a*. Resistor 50, together with capacitor 58, form a low pass filter that eliminates high frequency noise which may be transmitted by the conductors 19*c* and 40, for example. Resistors 84 and 86 are interposed in the circuit of switch 34*a* and are, for the other parameters indicated above, rated at 4,700 ohms and 100,000 ohms, respectively. Resistors 54 and 56 are eliminated, as indicated in the diagram of FIG. 5.

The power switch 34*a* is operable to receive a high voltage, low current, positive polarity, repeating pulse-type signal from a coil, such as the coil 18, to enable the switch to provide a stable voltage from battery 20, for example, between terminal 37 and terminal 76 of switch 34*a*. In contrast to the non-inverting PNP transistor 66 of the embodiment of FIG. 4, an NPN transistor 88 is connected as illustrated in FIG. 5. Transistor 88 inverts the signal applied at terminal 41 by 180 degrees, and as in the switch 34, establishes a base current through cascaded transistor 72 which results in a base current through transistor 74. The base current through transistor 74 produces a resultant voltage signal at terminal 76 which may be connected by way of a suitable conductor to an ancillary system, such as devices 30 or 30*a*, for example. Aside from the circuit elements which accommodate the inversion of the polarity of the pulse signal as described above, the circuitry of the switch 34*a* is substantially like that of the circuit of the switch 34.

Figure 6:
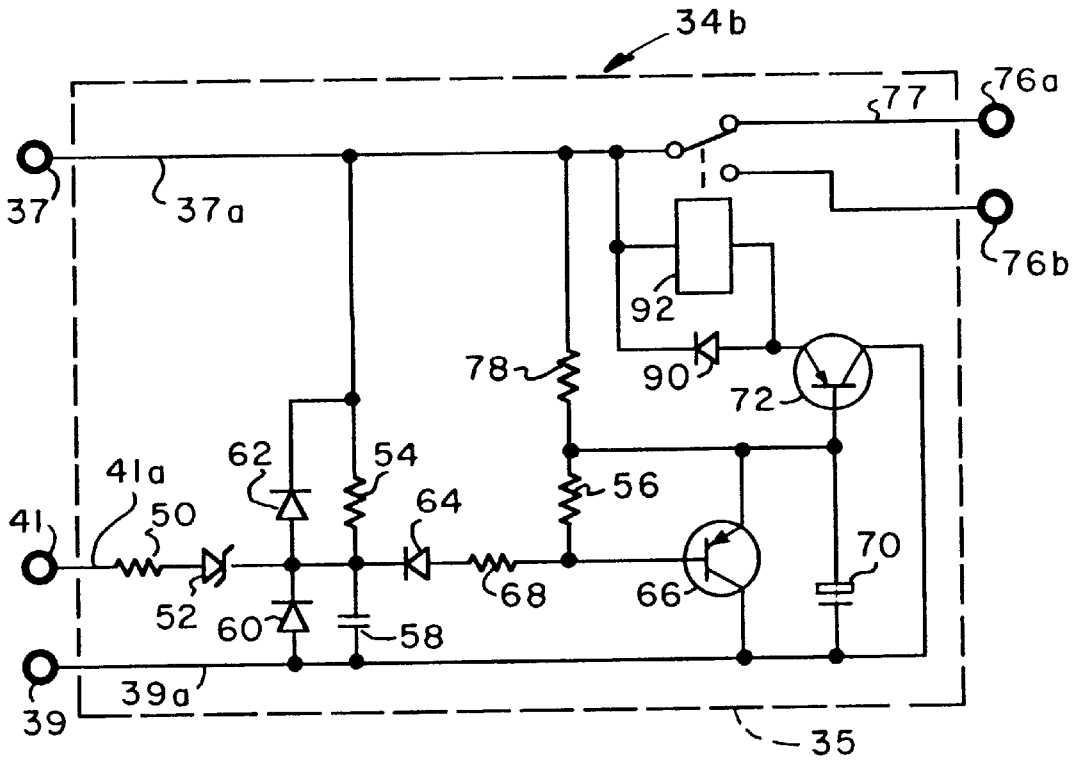
FIG. 6 is a schematic diagram of an embodiment of a power switch which interrupts power to an ancillary device.

Referring now to FIG. 6, there is illustrated another embodiment of a power switch in accordance with the present invention and generally designated by the numeral 34*b*. The power switch 34*b* includes those circuit elements indicated for the power switch 34 except that the transistor 74, the capacitor 82 and the resistors 80 and 81 have been replaced by a diode 90 and a relay 92, as shown, operably connected to the transistor 72 and operable to connect terminals 76*a* or 76*b* to the terminal 37 to provide electrical power to an ancillary system from the primary source 20, but in accordance with the manner in which the ancillary system is connected to the power switch. For example, when a high voltage repeating pulse-type signal is imposed on terminal 41, the action of transistor 66 and capacitor 70 will effect current flow through the relay 92, as a consequence of the operation of transistor 72, to disconnect terminal 76*a* from terminal 37 via conductor 37*a*. Accordingly, if an ancillary device, such as the device or system 30, is connected to terminal 76*a*, electrical power will be disconnected from the primary source when the coil 18 is providing an output signal. However, power from the primary source 20 will be supplied to terminal 76*b*. In this way, the power switch 34*b* provides optional connection points for connecting a system to the primary power source or disconnecting such a system from the power source when the switch 34*b* receives a repeating pulse high voltage signal.

Figure 7:
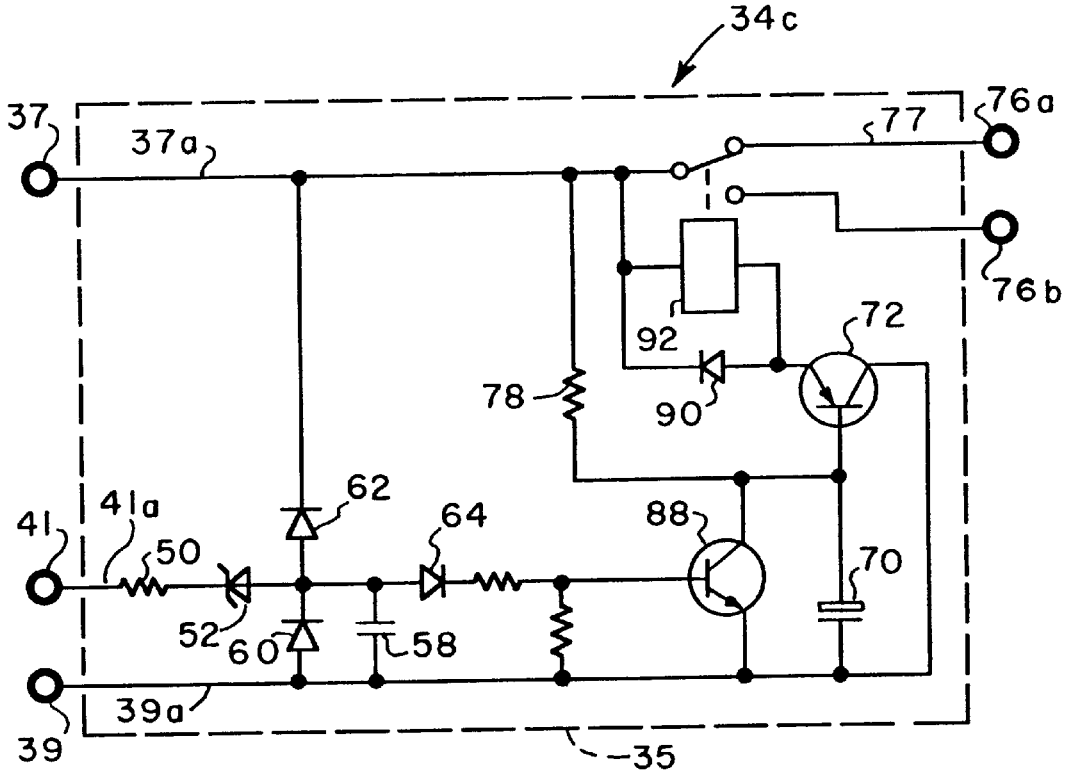
FIG. 7 is a schematic diagram of yet another embodiment of the present invention for interrupting power to an ancillary device.

Referring now to FIG. 7, still another embodiment of a power switch in accordance with the invention, is illustrated and generally designated by the numeral 34*c*. The power switch 34*c* is similar to the power switch 34*b* in that diode

90 and relay 92 are in circuit with transistor 72 which will effect current flow through the relay 92 as a consequence of a repeating pulse-type signal imposed on the circuit comprising the transistor 88 and the capacitor 70. The power switch 34*c* is similar in other respects to the power switch 34*a* and is used in systems wherein the high voltage repeating pulse-type signal imposed on terminal 41 is of positive polarity.

Accordingly, the switch embodiments illustrated in FIGS. 6 and 7 may be used in systems wherein it is desired to have the option of connecting an ancillary system to the primary power source when a high voltage pulse-type signal is received from the ignition coil or disconnecting the primary power source from the ancillary system when a high voltage pulse-type signal is being generated by the coil.

Although preferred embodiments of the invention have been described in detail hereinbefore, those skilled in the art will appreciate that various substitutions and modifications may be made to the invention without departing from the scope and spirit of the appended claims.

What is claimed is:

1. In an electrical system for an internal combustion engine having at least one sparkplug for igniting a fuel-air mixture, a first circuit for generating a pulse electrical signal, a power source for an electrical system of said engine and an ancillary system operable to perform a function in response to a signal generated by said first circuit, the improvement comprising:

a switch operably connected to said first circuit, said source and said ancillary system and responsive to receiving a repeating pulse-type signal from said first circuit to provide one of connecting electrical power from said source to said ancillary system and disconnecting electrical power from said source to said ancillary system.

2. The invention set forth in claim 1 wherein:

said switch comprise a second circuit including a first conductor connected to a signal output terminal of said first circuit and second and third conductors connected to said source, respectively.

3. The invention set forth in claim 2 wherein:

said switch includes a fourth conductor operable to be connected to said ancillary system for providing a substantially constant voltage signal to said ancillary system in response to receiving a pulse signal from said first conductor.

4. The invention set forth in claim 3 wherein:

said switch includes a circuit element in said second circuit connected to said first conductor and operable to limit energy transmitted via said pulse-type signal, said circuit element being selected from a group consisting of a resistor, a capacitor, an inductor, a transistor, a Zener diode, a silicon-controlled rectifier, and a controlled leakage diode.

5. The invention set forth in claim 4 wherein:

said circuit element comprises a resistor.

6. The invention set forth in claim 4 wherein:

said second circuit includes a low voltage filter for blocking a signal having a voltage less than about twelve volts to at least a portion of said second circuit.

7. The invention set forth in claim 6 wherein:

said low voltage filter includes a Zener diode and at least one resistor.

8. The invention set forth in claim 4 including:

a resistor and a capacitor in said second circuit and forming a low pass filter to eliminate high frequency noise from said first conductor.

9. The invention set forth in claim 4 including:

a first diode operable to clamp a resultant negative voltage signal from said first conductor and a second diode operable to clamp a resultant positive voltage signal from said first conductor to a value less than about 1.0 volts greater than the voltage of said source.

10. The invention set forth in claim 4 wherein:

said second circuit includes a first transistor and a capacitor operable to provide current to a second transistor in response to receiving said pulse-type signal.

11. The invention set forth in claim 10 wherein:

said second transistor is arranged in said second circuit in cascade with a third transistor for causing said third transistor to conduct a base current therethrough at a resultant voltage to provide electrical power from said source to said ancillary system.

12. The invention set forth in claim 11 including:

resistor means in circuit with said transistors and operable to provide a stable off state of said power switch in the absence of said pulse-type signal from said coil.

13. The invention set forth in claim 10 wherein:

said second transistor is in circuit with a relay operable to disconnect said source from said ancillary system in response to said pulse-type signal imposed on said switch from said first circuit.

* * * * *